US007474043B2

(12) United States Patent
Scholeno et al.

(10) Patent No.: US 7,474,043 B2
(45) Date of Patent: Jan. 6, 2009

(54) DOUBLE-ENDED LAMP SOCKET WITH BULB REMOVAL FEATURE

(75) Inventors: Michael F. Scholeno, Lakewood, NY (US); Shane Brown, York, PA (US)

(73) Assignee: Osram Sylvania Inc., Danvers, MA (US)

( * ) Notice: Subject to any disclaimer, the term of this patent is extended or adjusted under 35 U.S.C. 154(b) by 458 days.

(21) Appl. No.: 11/397,043

(22) Filed: Apr. 3, 2006

(65) Prior Publication Data

US 2007/0228921 A1 Oct. 4, 2007

(51) Int. Cl.
*H01J 5/48* (2006.01)

(52) U.S. Cl. ..... 313/318.01; 313/318.02; 445/62

(58) Field of Classification Search ..... 313/49, 313/50, 51, 318.01–318.12, 422, 493, 634, 313/607, 484–485, 514–515, 519, 631, 633, 313/491, 483, 475, 473, 56, 169.4; 439/611–619, 439/739

See application file for complete search history.

(56) References Cited

U.S. PATENT DOCUMENTS 3,781,759 A * 12/1973 Shelly, Jr. ..... 439/232
4,795,357 A * 1/1989 Kosmol et al. ..... 439/232
5,261,831 A * 11/1993 Vendal et al. ..... 439/232
5,731,656 A * 3/1998 Greiler et al. ..... 313/318.01

* cited by examiner

*Primary Examiner*—Peter J Macchiarolo
*Assistant Examiner*—Donald L Raleigh
(74) *Attorney, Agent, or Firm*—William H. McNeil

(57) ABSTRACT

A socket (10) for a double-ended lamp (12) having an electrical contact (14) at each end (15) has a housing (16) with a base (20) and including spaced apart electrical contact receiving areas (18) formed on the base (20). At least one ejector (22) for the double-ended lamp (12) is associated with at least one of the contact receiving areas (18).

4 Claims, 3 Drawing Sheets

DOUBLE-ENDED LAMP SOCKET WITH BULB REMOVAL FEATURE

TECHNICAL FIELD

This invention relates to lamp sockets and more particularly to high temperature lamp sockets for double-ended lamps. Still more particularly, it relates to such a socket that includes a lamp removal feature.

BACKGROUND ART

Double-ended metal halide arc discharge lamps are known. Some kinds of these lamps have achieved wide usage in entertainment lighting. One particular version of such a lamp is designated SharXS® and is produced by Osram Photo-Optic. Lamps of this type are available from Osram Sylvania Inc., Danvers, Mass. 01923. These lamps are provided in wattages from 200 to 1200 and operate at quite high temperatures. In fact, typical operating temperatures in area of the socket are in the range of 200 to 300° C. It is, of course, imperative that the sockets employed with these lamps also be able to operate for long periods of time at such temperatures and still maintain good electrical contact. One type of socket for double-ended lamps is shown and described in German Gebrauchmuster No. 295 04 517, filed Mar. 22, 1995. The socket utilizes a pair of spaced ceramic bodies containing electrical contacts in the form of a single spring that often results in poor contact resistance. To solve the latter problem a lamp socket has been supplied that provides supplemental springs. Such a socket is shown in pending U.S. patent application Ser. No. 10/930,664, fled Aug. 31, 2004 and assigned to the assignee of the instant invention and, while it solves the poor contact resistance problem, makes the lamp somewhat difficult to remove from the socket because of the high frictional forces existing between the lamp contacts and the socket springs and because many luminaries have limited space, making it extremely difficult for an operator to get his or her hands into an appropriate position to remove an old lamp and insert a new one.

DISCLOSURE OF INVENTION

Accordingly, it is therefore an object of this invention to obviate the disadvantages of the prior art.

It is another object of the invention to enhance the operation of lamp sockets.

Yet another object of the invention is the facilitation of lamp removal from a socket.

These objects are achieved, in one aspect of the invention by the provision of a socket for a double-ended lamp, which lamp has an electrical contact at each end and wherein the socket includes a housing having spaced apart electrical contact receiving areas formed on a base and at least one ejector for the double-ended lamp associated with at least one of the contact receiving areas.

In a preferred embodiment of the invention each of the electrical contact receiving areas is provided with an ejector.

The lamp ejector is easy to operate and inexpensive to provide and greatly facilitates the removal of a lamp, especially for replacement purposes

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
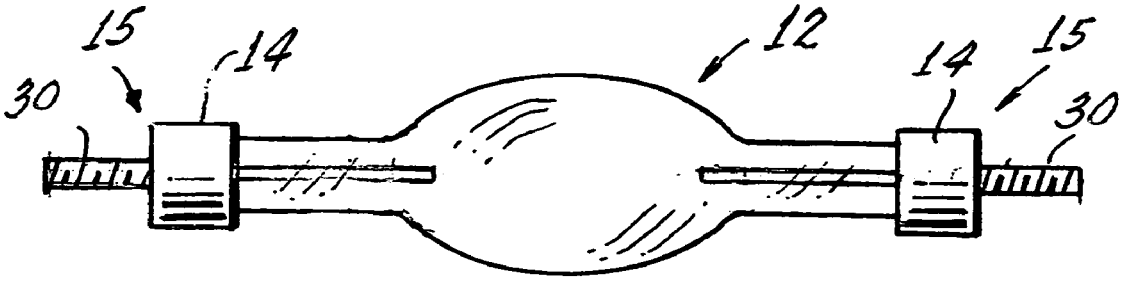
FIG. 1 is an elevational view of a lamp that can be used with the invention.

Referring now to the drawings with greater particularity there is shown in FIG. 1 a double-ended lamp 12 having contacts 14 at each end 15 and a projection 30 extending beyond the contacts 14. The contacts 14 have a given diameter and the projections 30, which can be threaded, have a diameter less than the given diameter.

Figure 6:
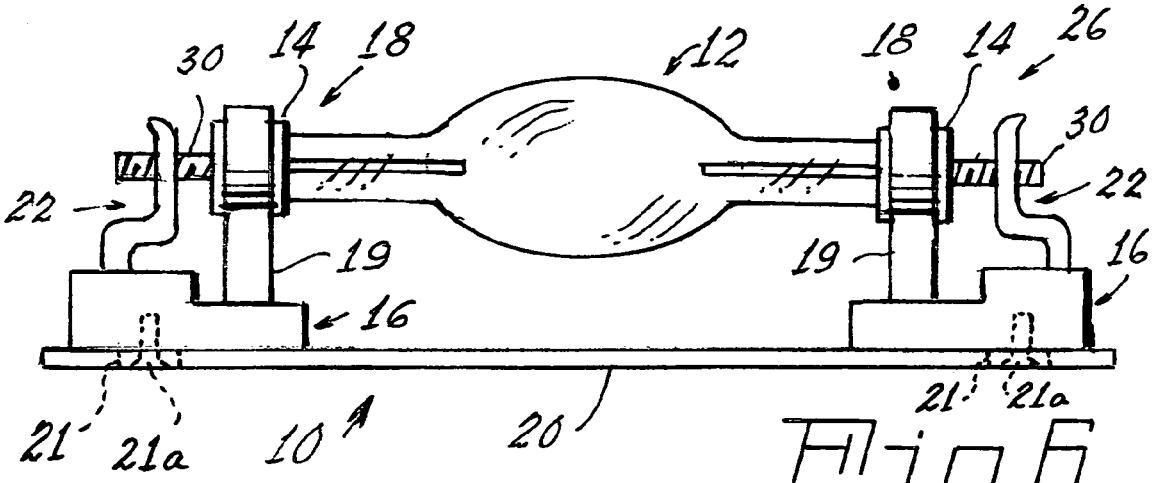
FIG. 6 is a side elevational view of a lamp-socket assembly.
Figure 5:
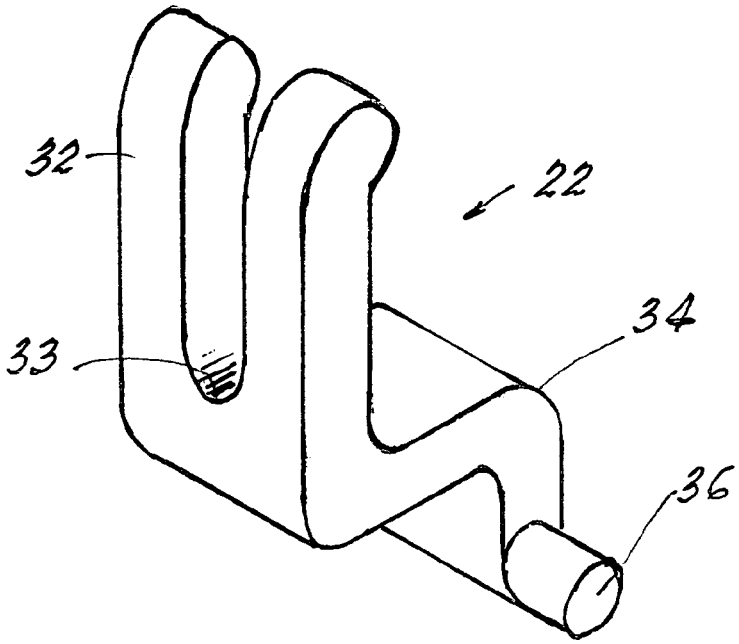
FIG. 5 is perspective view of a lever employable with an aspect of the invention.

The lamp and socket assembly 26 is shown generally in FIG. 6 and comprises a socket 10 having spaced apart housings 16 mounted upon a base 20. The housings 16 carry electrical contact receiving areas 18. The base 20 is preferably provided with elongated slots 21 to receive fasteners 21*a* to allow accurate positioning of the housings 16 thereon. The base 20 can be any suitable material such as steel while the housings 16 are formed of a high temperature ceramic such as steatite. Other useful materials include cordierite, alumina and porcelain.

The double-ended lamp 12 is fitted to the socket 10 with the contacts 14, which have a given diameter, engaged with electrical contact receiving areas 18, which take the form of U-shaped springs 19. The projections 30 extend from each of the ends 15 and the projections 30 have a diameter less than the contact diameter.

In a preferred embodiment of the invention the springs 19 can take the form shown in the above-identified patent application, Ser. No. 10/930,664, the teachings of which are hereby incorporated by reference.

Figure 2:
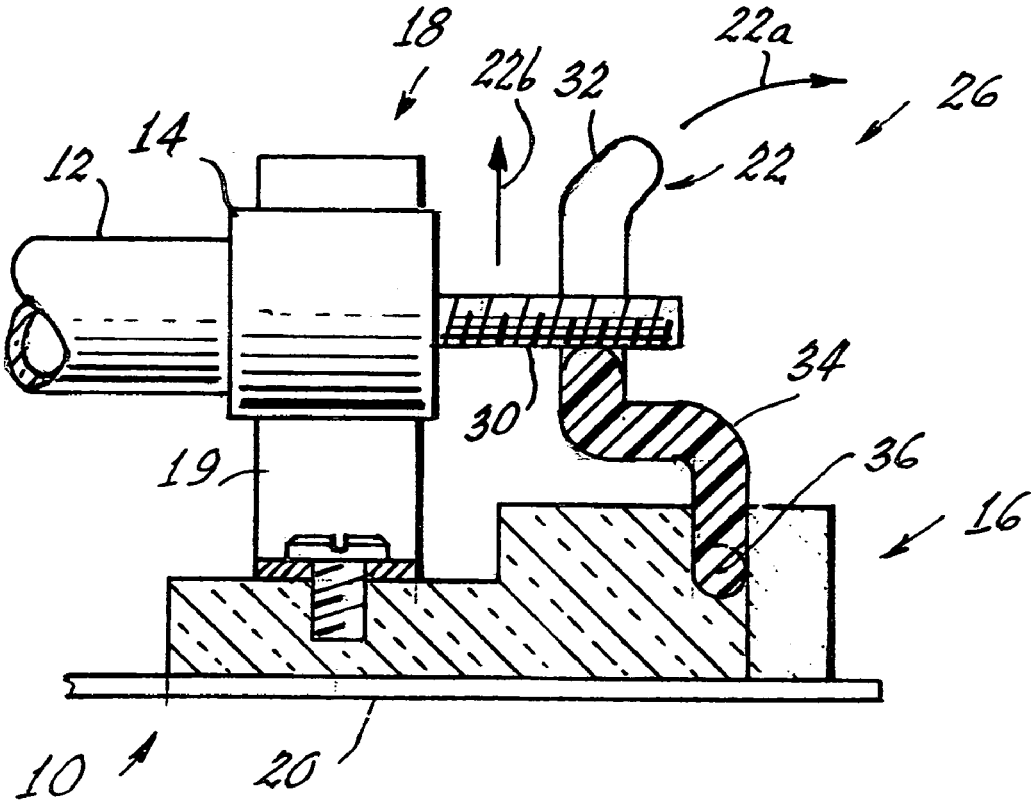
FIG. 2 is a diagrammatic view of an embodiment of the invention in a first position.
Figure 3:
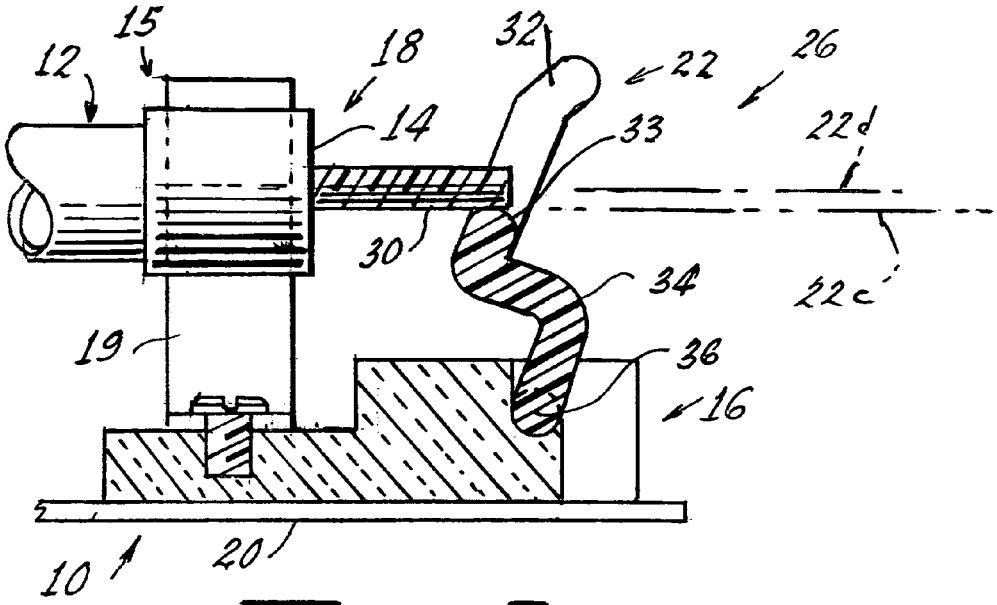
FIG. 3 is a diagrammatic view of an embodiment of the invention in a second position.

One end of a socket 10 is shown in enlarged views in FIGS. 2 and 3, it being understood that the other end of the socket 10 is a mirror image, with an ejector 22 for the double-ended lamp 12 associated with the contact receiving areas 18. For example, the ejectors 22 are adjacent the contact receiving areas 18 near the outer edge of the socket 10. FIG. 2 illustrates the lamp in the operating position and FIG. 3 illustrates the lamp in the removable position after the ejector 22 has been activated. The arrow 22*a* shows the direction of movement of the ejector 22 and the arrow 22*b* shows the direction of movement of the lamp 12. This feature is shown also in FIG. 3 wherein the line 22*c* represents the bottom edge of a projection 30 when installed and the line 22*d* represents the bottom edge of projection 30 after the ejector 22 has been activated.

The ejector 22 comprises a first portion 32 that is a U-shaped and a second portion 34 comprising a pivot arm 36 mounted with the housing 16 in any convenient manner. The first portion 32 grasps the projection 30 so that the projection 30 is in contact with the bight 33, which preferably is rounded as shown in the drawings to allow the ejector 22 to slide on the threaded projection 30 without interference caused by the threads. The ejector 22 is preferably formed from cast aluminum; however, other materials such as high temperature plastics can also be employed.

Figure 4:
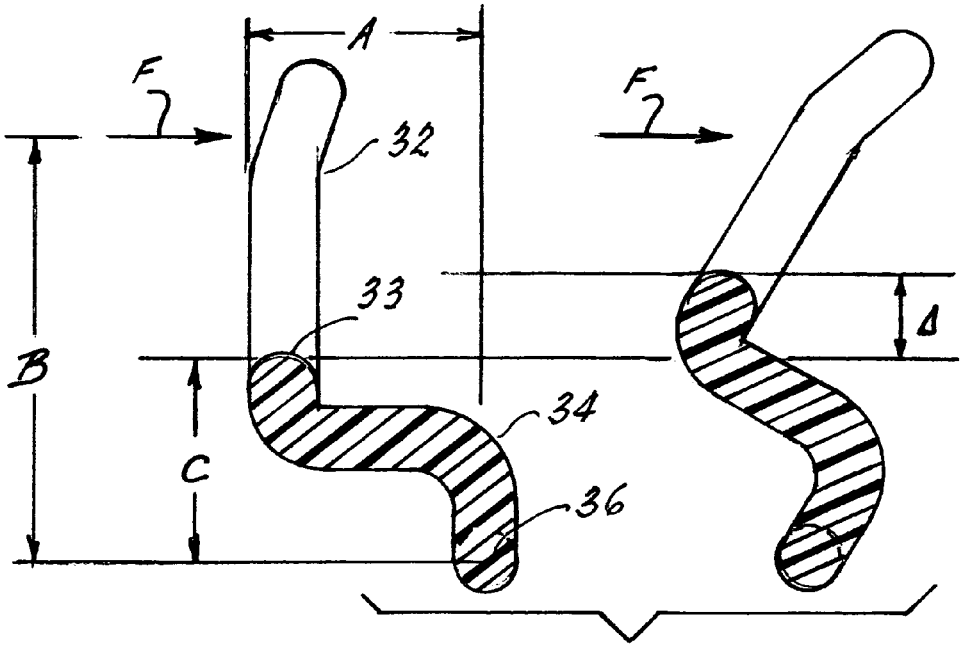
FIG. 4 is an enlarged diagrammatic view of the two positions of the lever of the invention.

Referring now to FIG. 4, there is shown a diagrammatic representation of the operation of the ejector 22. When a force is applied, as shown by the arrow labeled F, the ejector 22 rotates about the pivot arm 36 and provides the vertical lift Δ. That action causes the contact 14 to disengage from the spring 19 and allow the lamp 12 to be removed from the socket.

The technique is amenable to many situations and sizes of socket and lamp. For example, the dimensions A, B and C can be optimized to obtain the desired performance. That is, the dimension A determines the maximum vertical motion while dimension B controls the force at dimension C. Increasing B and decreasing C equals increased force output at C, while decreasing B and increasing C equals decreased force output at C.

Further, the C dimension determines the start angle of the ejector. When C is small the start angle will be close to 90° with respect to the pivot point: When C is large the start angle will be close to 180° with respect to the pivot point.

Thus there is provided a socket with an ejector feature allowing relatively easy lamp replacement even when the lamp is held in place by strong frictional contact and where space is limited.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. In a socket for a double-ended lamp having an electrical contact at each end, said socket having:

a housing including a base with spaced apart electrical contact receiving areas formed on said base; the improvement comprising:

at least one ejector for said double-ended lamp associated with at least one of said contact receiving areas, said ejector comprising a first portion that is U-shaped and a second portion comprising a pivot arm mounted with said housing.

2. The socket of claim 1 wherein said electrical contact receiving areas comprise springs adapted to frictionally receive said electrical contacts and said at least one ejector is positioned adjacent at least one of said springs.

3. An assembly comprising:

a socket having a housing including a base with spaced-apart electrical contact receiving areas formed on said base; and a double-ended lamp fitted to said socket, said double-ended lamp having an electrical contact at each end thereof, said contacts having a given diameter and being engaged with said electrical contact receiving areas, and a projection extending from each of said ends, said projection having a diameter less than said contact diameter; and at least one ejector for said double-ended lamp associated with at least one of said contact receiving areas, said ejector comprising a first portion that is a U-shaped and a second portion comprising a pivot arm mounted with said housing.

4. The assembly of claim 3 wherein said first portion grasps said projection.

* * * * *